US005713765A

United States Patent [19]

Nugent

[11] Patent Number: 5,713,765

[45] Date of Patent: Feb. 3, 1998

[54] HIGH-CURRENT AUDIO CONNECTOR

[76] Inventor: Steven F. Nugent, 3240 NW. 132nd Pl., Portland, Oreg. 97229

[21] Appl. No.: 636,234

[22] Filed: Apr. 23, 1996

[51] Int. Cl.[6] ..... H01R 15/12; H01R 13/24; H01R 13/625

[52] U.S. Cl. ..... 439/700; 439/217; 439/319; 439/801; 439/884

[58] Field of Search ..... 439/700, 728, 439/729, 784, 805, 819, 820, 824, 217, 319, 801, 810; 411/147, 160–165, 137

[56] References Cited

U.S. PATENT DOCUMENTS

| | | | |
|---|---|---|---|
| 903,768 | 11/1908 | Platt | 439/551 |
| 1,190,525 | 7/1916 | Douglas | 439/824 |
| 1,687,074 | 10/1928 | Wichert | 439/700 |
| 2,093,037 | 9/1937 | Douglas | 439/289 |
| 2,265,998 | 12/1941 | Bruno | 439/289 |
| 2,882,509 | 4/1959 | Archer et al. | 439/289 |
| 3,519,976 | 7/1970 | Orr | 439/146 |
| 4,083,622 | 4/1978 | Neidecker | 339/256 R |
| 4,203,647 | 5/1980 | Bonhomme | 339/256 R |
| 4,405,196 | 9/1983 | Fulton | 339/273 F |
| 4,662,706 | 5/1987 | Foley | 339/256 R |
| 4,960,395 | 10/1990 | Ushler | 439/864 |
| 5,176,542 | 1/1993 | Grappe | 439/821 |
| 5,220,126 | 6/1993 | Borgwarth et al. | 89/28.05 |
| 5,423,692 | 6/1995 | Francis | 439/335 |
| 5,529,510 | 6/1996 | Wakata et al. | 439/824 |

FOREIGN PATENT DOCUMENTS 4-334908 11/1992 Japan .

*Primary Examiner*—Neil Abrams

[57] ABSTRACT

A conical contact of a male plug is biased by a coil spring which rides on a cylindrical tail. A bushing compresses the spring, but is held captive on the tail by a pin passing radially through the bushing and a slot through the tail. A female receptacle has a conical hole to receive the conical contact. A sleeve extends from the hole, providing two ramp shaped slots to engage the protruding ends of the pin on the male plug. When the connector is mated, the bushing is inserted into the sleeve and the ends of the pin engage the slots in the sleeve, causing the conical contact to enter the conical hole. Rotation of the bushing causes the ends of the pin to ride the ramp shaped slots inward, causing the conical contact to rotate as the spring compresses, forcing the conical contact into the conical hole. When fully mated, the ends of the pin fall into detent positions at the ends of the slots, locking the connector. Biased by a spring, the matching tapers of the conical contact and conical hole provide a low-resistance, high-current non-compliant connection, while the detents lock the connector, eliminating accidental dis-connection.

4 Claims, 4 Drawing Sheets

HIGH-CURRENT AUDIO CONNECTOR

BACKGROUND OF THE INVENTION

1. Field of the Invention

The present invention relates to the field of audio electronics, and in particular to connectors for connecting high-current cables to loudspeakers and power amplifiers.

2. Description of the Related Art

Connectors used to terminate loudspeaker cabling have historically included binding posts and modified types of binding posts. Because the currents can be relatively high (50–100 amps) between audio power amplifiers and loudspeakers, mechanical clamping is usually required to achieve low resistance at the cable termination.

The majority of high-fidelity loudspeaker and power amplifier manufacturers utilize a universal binding post called a "5-way binding post" or a variant thereof for this purpose. A prior-art 5-way binding post is illustrated in FIG. 1. FIG. 2 is a section view of the same. The 5-way binding post provides 3 preferred methods to attach and electrically terminate speaker cabling.

The most common and preferred method used to terminate loudspeaker cables is by attaching fork-shaped spade lugs as illustrated in FIG. 4 to the cable. Referring to FIG. 1, after the spade lug is crimped or soldered on to the cable, it is screwed down tightly under a nut or threaded sleeve 8 that is threaded onto a threaded post 7. The spade lug is clamped between the nut 8 and a flange 6 to make a tight electrical connection. The tail of the threaded post 9 then connects to the wiring inside of the loudspeaker or power amplifier. The connector is mounted to the loudspeaker or power amplifier chassis by a nut 4 that is tightened against a flange 6. Referring to FIG. 4, the spade lug has the disadvantage that the cross-sectional area 12 is limited between the cable crimp-termination 13 and the "forked" area 11, which is clamped in the binding post. The small cross-sectional area 12 contributes to the resistance of the connection. Some manufacturers have improved upon this by offering very thick spade lugs, however the thicker material can make them difficult to crimp on the cable ends. They are also more difficult to deform during the clamping process, resulting in a less-than-optimal connection. The surface area of the spade lug 11 that is in contact with the nut of the binding post is also limited by it's U-shape. Another significant disadvantage is that movement of the cable can loosen the connection, causing high resistance and signal degradation. The spade lugs can also fall off of the binding posts potentially causing equipment-damaging shorts. Yet another disadvantage is that spade lugs can become contaminated, sustain damage and become worn. It is quite common that spade lugs have their gold-plating worn off from being repeatedly clamped under binding posts. The clamping of spade lugs in 5-way binding posts does not inherently cause a wiping action. Therefore, contamination on the spade-lug or the binding post may not be removed when they are mated.

Referring again to FIG. 1, the second most common method used to terminate loudspeaker cabling is to strip a short length of insulation from the end of the conductors of the cable and insert each stripped end into a hole drilled 2 across the diameter of the base of the threaded post 3. A nut 8 is then threaded onto the threaded post 7 and tightened against the stripped bare wire. This method has the disadvantage that it deforms the stripped ends of the wire when the nut 8 is tightened. If the cable is to be changed from one speaker to another as is typical in a sales showroom, the cable ends will soon deteriorate and require re-stripping. Another disadvantage of this method is that the hole 2 is typically sized for the largest wire gauge that is anticipated and requires that the wire be composed of relatively large gauge strands to prevent the strands from breaking off during the tightening process. Unfortunately, many high-quality loudspeaker cables consist of large numbers of very fine gauge strands of wire that are woven or sometimes laid in a tubular arrangement around a form. These types of cables would experience severe damage if clamped in the hole 2. Some manufacturers provide end termination pins that electrically attach to the loudspeaker cable and are sized to fit through hole 2. This eliminates the clamping damage experienced with bare stripped wires, but when clamped the pin only makes contact with the bottom of hole 2, reducing contact area and increasing resistance.

Referring to FIG. 1 and FIG. 3, the third commonly used method of termination utilizes a hole that is bored the length of the post 3, creating a cylindrical jack 1. The end of the cable is first terminated to a banana plug as illustrated in FIG. 3. To make the connection, the banana plug of FIG. 3 is plugged into the hole 1 in the post. Springs 10 attached or integral to the banana plug create pressure against the inside of the bore hole 1 to make electrical contact. The banana plug has the disadvantage that the retention is not good and therefore cable movement can cause poor connections and even equipment-damaging shorts when they pull out. Some manufacturers have made available locking banana plugs which are much more difficult to pull out, but these typically sacrifice contact area for more contact pressure thereby achieving better retention. The current banana-plug designs only achieve partial contact with the interior of the jack. The contact area and pressure on typical banana plugs limits their ability to maintain low resistance when carrying the large currents experienced in modem high-fidelity equipment. Banana plugs are prone to spring-fatigue, damage and contamination.

Existing methods for electrically connecting cables to speakers and power amplifiers suffer from a number of weaknesses, including: being prone to accidental disconnection, having significant and unpredictable contact resistance, wearing of gold-plated surfaces through repeated mating and damage to the cable ends.

SUMMARY OF THE INVENTION

A two-piece single-contact audio connector according to the present invention includes a conical tapered male plug which terminates a cable and a mating female receptacle which mounts to a panel or bulkhead. When the connector is mated by rotating components of the male portion with respect to the female portion, the tapered male plug is compressed into the tapered hole in the female receptacle, achieving an low-resistance contact. When mated, the connector is locked and cannot become accidently disconnected.

According to the preferred embodiment, the female receptacle includes a conical tapered hole and a threaded post for panel mounting. A sleeve extends from the end with the tapered hole and includes two opposing ramp shaped slots for interlocking with the male plug.

The male plug includes a conical contact and a cylindrical tail extending axially opposite the contact. A bushing slides on the tail, bearing against a coil spring and causing it to compress against a shoulder at the transition between the tail and the conical contact. A cylindrical pin passes through a radial bore in the bushing and also through a slot cut axially in the tail of the male plug. The pin is captive in the bushing, but the bushing and pin slide freely in the slot in the tail of the male plug. The pin extends outside the bushing on both sides providing a means to interlock with two slots in the sleeve that extends from the female receptacle. When the connector halves are engaged, the bushing is inserted into the sleeve and the ends of the pin engage with two ramp shaped slots in the sleeve. As the bushing is rotated, the conical male contact also rotates as the spring is compressed between the bushing and the shoulder on the male plug. As the spring is compressed, the male contact is pressed into the female receptacle. When the connector is completely mated, the ends of the pin fall into detent positions in the slots in the sleeve.

As a feature of the preferred embodiment of the present invention, the pin retains the bushing and spring on the tail of the male plug.

As another feature of the preferred embodiment of the present invention, the pin causes the tapered contact to rotate with respect to the tapered hole during mating. This has the advantage of breaking through any oxide on the contact surfaces or otherwise removing contaminants to achieve a low-resistance contact.

As yet another feature of the preferred embodiment of the present invention, the slots in the sleeve form a ramp which serves as a mechanical advantage when mating the connector. The ramp feature allows the connector to be mated by only rotating the bushing as opposed to the common push-and-rotate mating. This is an advantage when the connector is located in a tight space, is awkward to access, or the equipment cannot be held stationary while mating.

A modified version of the present invention eliminates the axial slot in the tail of the male plug. Mating of the connector is accomplished using a cap or bushing that slides over the tail on the tapered plug and interlocks with features on the female receptacle. The cap or bushing acts as a spring-compression means. Located under the cap or bushing is a spring. As the spring-compression means is engaged with the female receptacle, it compresses the spring against a shoulder on the male plug pressing the conical contact into the female receptacle.

As a feature of the modified embodiment of the present invention, a snap-ring or roll-pin is used to retain the cap or bushing and spring on the tail of the male plug. This has the advantage that axial slot in the tail of the male plug is eliminated, creating a simpler part to manufacture.

The present invention demonstrates improvements and advantages over the existing means for terminating loudspeaker cables to loudspeakers and power amplifiers in that it provides a low-resistance contact, a positive means for retention of the connector halves, contains no parts that can loosen and fall off and prevents damage to the ends of the conductors through repeated mating.

Other objects, advantages and novel features of the present invention will become more apparent from the following detailed description in conjunction with the accompanying drawings.

DETAILED DESCRIPTION OF THE INVENTION

The present invention is a connector system that can be used to connect cable to loudspeakers and power amplifiers.

Figure 3:
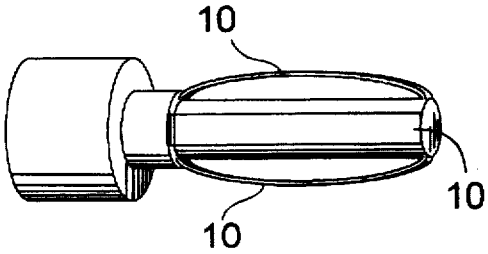
Fig. 3 (Prior Art)
FIG. 3 illustrates a prior art Banana Plug.
Figure 4:
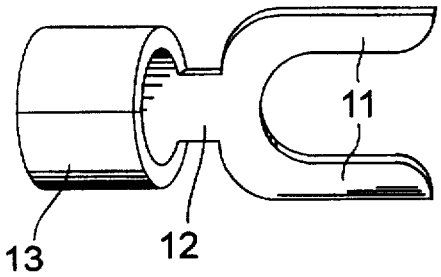
Fig. 4 (Prior Art)
FIG. 4 illustrates a prior art Spade Lug.
Figure 2:
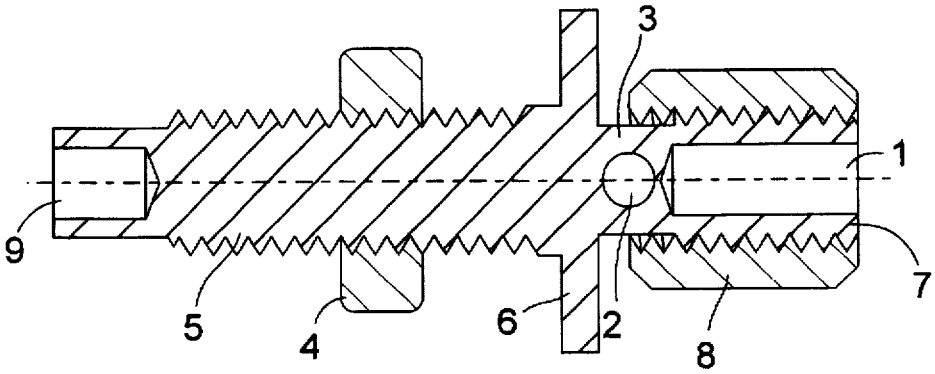
FIG. 2 illustrates a section view of a prior art 5-way binding post.
Figure 1:
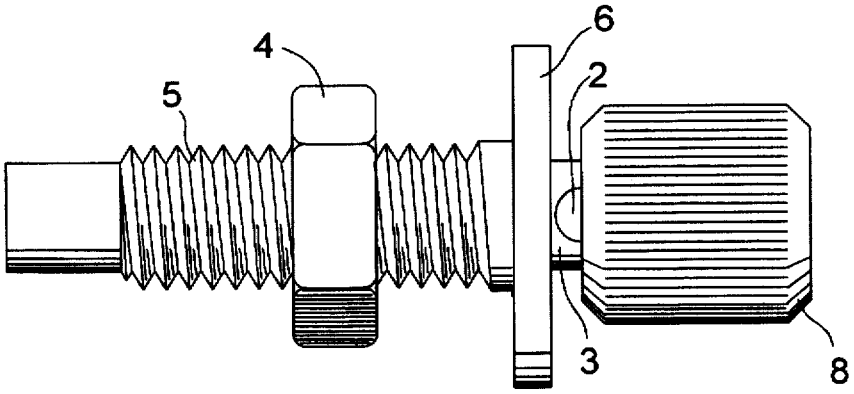
Fig. 1 (Prior Art)
FIG. 1 illustrates a prior-art 5-way binding post.
Figure 7:
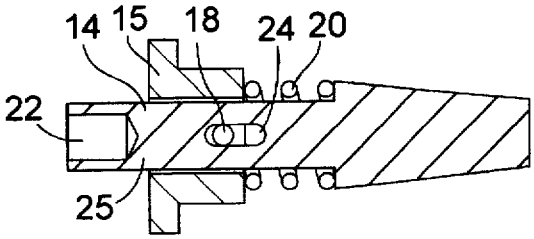
FIG. 7 illustrates a second section view of the male connector portion of the preferred embodiment of the invention.
Figure 6:
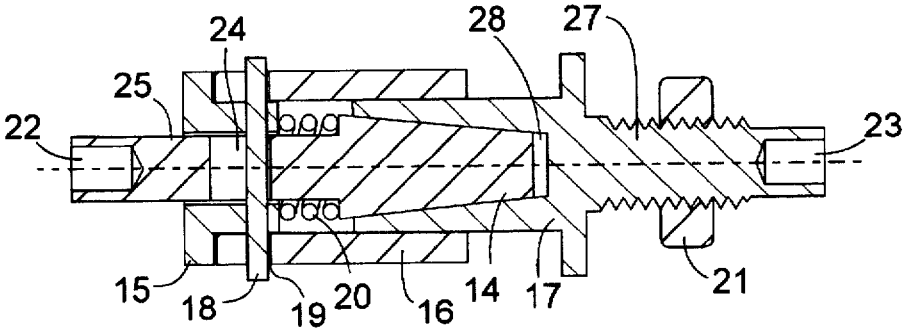
FIG. 6 illustrates a mated section view of the preferred embodiment of the invention.
Figure 5:
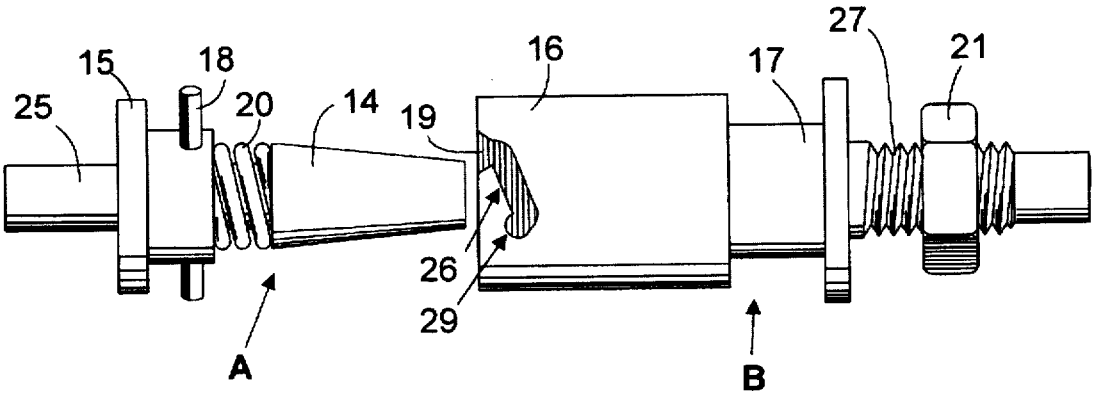
FIG. 5 illustrates the two-piece connector of the preferred embodiment of the invention.

The invention comprises two assemblies, a male plug A that terminates the ends of a loudspeaker cable and a mating female receptacle B that mounts to a loudspeaker or power amplifier chassis. FIG. 5 illustrates the preferred embodiment of the invention. FIG. 6 is a section drawing of a mated connector. FIG. 7 is a section rotated view of the male portion of the connector.

Referring to FIGS. 5, 6 and 7, the male plug consists of a conductive-metal conical tapered contact 14 which mates with a conical tapered hole 28 in a conductive-metal female receptacle. A tail 25 extends from the large end of the conical tapered contact 14. A coil spring 20 wraps around the tail 25 of the male plug. The large end of the tapered contact 14 is larger diameter than the tail 25, forming a shoulder that spring 20 can stop against. A bushing 15, slips over the tail 25 of the male plug causing spring 20 to be captive against the shoulder of tapered contact 14. Tail 25 has an elongated slot 24 running axially along its' length. Cylindrical pin 18 passes through a radial bore in bushing 15 and slot 24 in the tail 25 of the male plug, retaining both spring 20 and bushing 15 on tail 25. Pin 18 is smaller diameter than slot 24, therefore it can slide in slot 24 enabling bushing 15 to compress spring 20. When the connector is mated, spring 20 is fully compressed as pin 18 slides in slot 24 closer to contact 14 as shown in FIG. 6. When unmated, spring 20 is relaxed and pin 18 slides in slot 24 away from contact 14 as shown in FIG. 7. A bore 22 in the end of tail 25 provides a means for termination to wire conductors by crimping or soldering.

The female receptacle consists of a metal receptacle body 17 with a tapered hole 28 to receive the tapered contact 14 of the male plug. The tapered hole 28 is smaller diameter than the tapered contact 14, creating a gap between the end of the tapered contact 14 and the bottom of the hole 28 when mated, which prevents the tapered end 14 from bottoming-out. Opposite the tapered hole in receptacle body 17 is a threaded post 27 shown with nut 21 for panel mounting. A bore 23 in the end of the threaded post 27 provides a means for electrically terminating to wire conductors at a panel or bulkhead. A sleeve 16 surrounds and extends from the receptacle body 17, being rigidly attached thereto. Two opposing ramp shaped slots 19 in sleeve 16 are sized to accept the ends of pin 18.

Engagement of the male plug with the female receptacle is accomplished by manually inserting and rotating hushing 15 into sleeve 16 so that the ends of pin 18 engage with the two ramp shaped slots 19. The rotational mating action causes the ends of pin 18 to ride up the ramps 26 of slots 19, compressing the spring 20 and forcing the tapered contact 14 of the male plug into the tapered hole 28 of the female receptacle body 17. When the connector is fully engaged, the ends of pin 18 fall into detents 29 which lock the male and female halves together preventing them from disengaging while maintaining compression of spring 20. To disconnect the connector, bushing 15 of the male plug is rotated with respect to the female receptacle body 17 in the opposite direction as that used for mating.

It is desirable for the contact areas 14 and 28 to wipe during mating in order to help remove any dust or contamination. When mating, the relative rotational action of the tapered contact 14 of the male plug with respect to the female receptacle body accomplishes this wiping action. It is not necessary to push the mating halves together to mate them, only engagement and rotation is required. The precise conical taper of the tapered contact 14 and the matching taper of the receptacle tapered hole 28 insures a large contact area resulting in low resistance.

Figure 9:
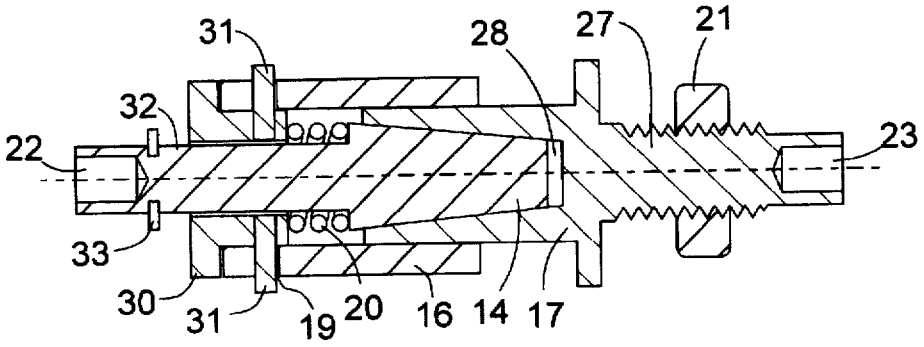
FIG. 9 illustrates a mated section view of the first modified connector of the invention using a snap-ring retention.
Figure 8:
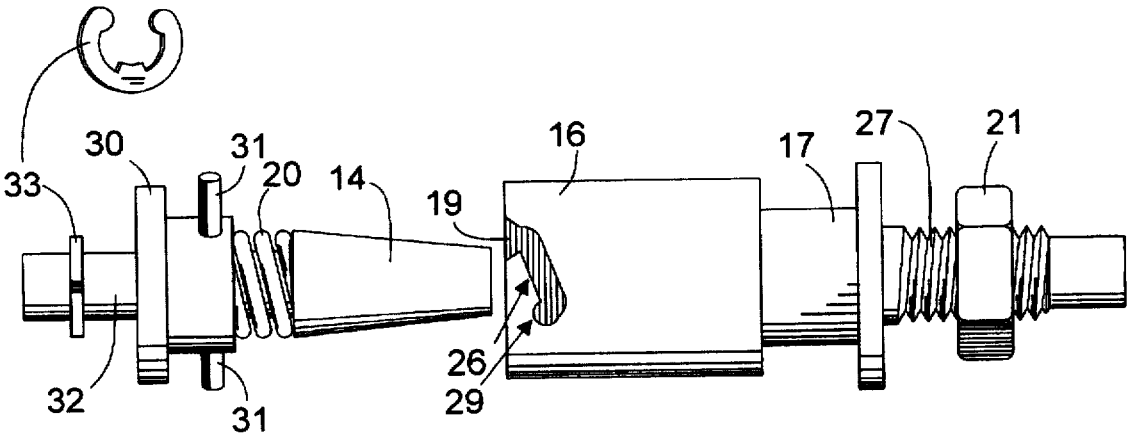
FIG. 8 illustrates a first modified two-piece connector of the invention using a snap-ring retention.

In the first modified connector of FIG. 8 and FIG. 9, the bushing and spring are retained by a snap-ring 33. In this embodiment of the invention the tail 32 of the male plug includes a radial groove for a snap-ring 33 to retain bushing 30 and spring 20. The interlocking means consists of two separate pins 31 that are captive in bushing 30. When the connector is engaged, pins 31 of bushing 30 interlock with slots 19 in sleeve 16. Rotation of bushing 30 relative to receptacle body 17 forces tapered contact 14 of the male plug into the tapered hole 28. Rotation of the bushing 30 does not generally cause the tapered end 14 of the male plug to rotate during mating.

Figure 11:
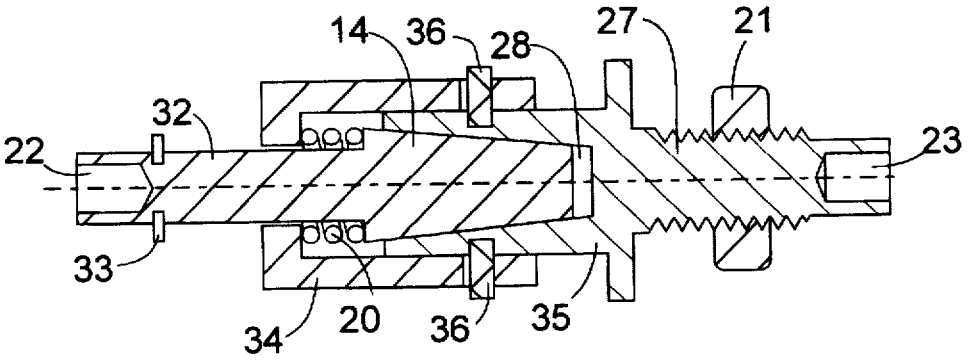
FIG. 11 illustrates a mated section view of the second modified connector of the invention with reversed interlocking features and snap-ring retention.
Figure 10:
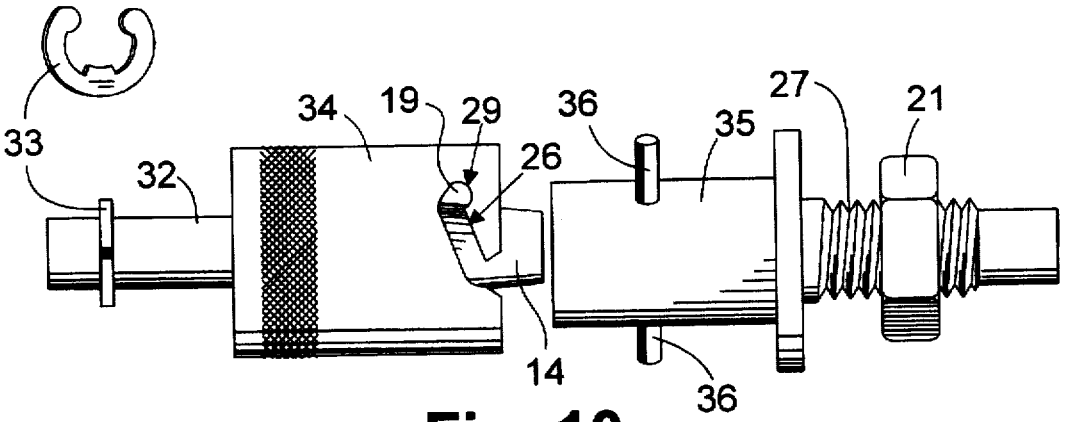
FIG. 10 illustrates a second modified two-piece connector of the invention with reversed interlocking features using a snap-ring retention.

In the second modified connector of FIG. 10 and FIG. 11, the male and female interlocking features are reversed. Captive in the female receptacle body 35 are two separate pins 36 for interlocking with the male plug. The male plug includes a cylindrical cap 34 which slides on tail 32, causing spring 20 to be captive. Tail 32 includes a radial groove where a snap-ring 33 can be installed. Cap 34 has two slots 19 that interlock with pins 36 on the female receptacle body 35. A snap-ring 33 retains cap 34 and spring 20 on tail 32 of the male plug. When the openings of the slots 19 are engaged with the pins 36, rotation of the cap 34 with respect to the receptacle body 35 forces the tapered contact 14 of the male plug into the tapered hole 28 of the receptacle body 35. Rotation of the cap 34 does not generally cause the tapered end 14 of the male plug to rotate during mating.

Figure 12:
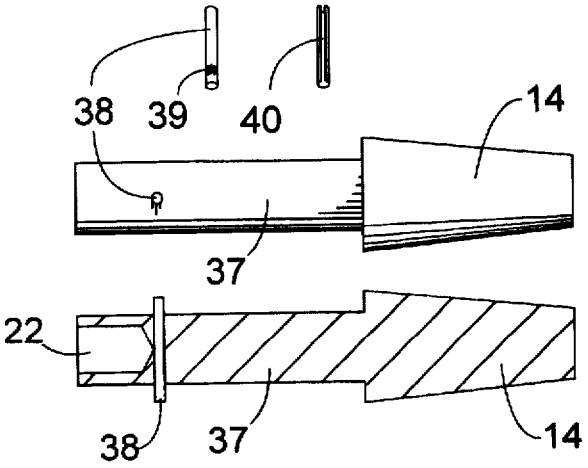
FIG. 12 illustrates an alternative pin-retention means that can be utilized with the first and second modified connectors of the invention.

The male plugs of the first and second modified embodiments of the invention can alternatively include a radial-pin in the tail as a retention means as opposed to a snap-ring. FIG. 12 shows a male tapered contact 14 with an extending tail 37 which is bored radially to accept pin 38. Pin 38 includes a knurled section 39 that bites into the radial bore in tail 37 causing it to be captive with both ends protruding from tail 37. Roll-pin 40 can be used for the same purpose as pin 38.

The use of the present invention is not limited to the connection of loudspeakers and power amplifiers, and the invention can also be applied to a wide variety of connections of the general type.

What is claimed is:

1. A connector including a male plug and a female receptacle, said male plug comprising:

a conductive conical tapered contact having a cylindrical tail protruding axially from the larger end of said contact thereby forming a shoulder at the transition, said tail having a radial bore which is axially elongate forming a slot therein, the end of said tail having means for electrical termination to single or multi-conductor wire;

a coil spring, riding on said tail such that the bottom of said spring bears against said shoulder;

a bushing, having a radial bore of smaller diameter than the width of said slot, located so as to ride on said tail and bear against the top of said coil spring, said radial bore aligning axially with said slot; and a cylindrical pin, extending through said radial bore in said bushing and said slot in said tail, for retention of said bushing and said spring on said tail, the ends of said cylindrical pin extending outside of said bushing so as to allow engagement with said female receptacle, said female receptacle comprising:

a conductive receptacle body having a conical tapered hole with the same taper and relative size as said conical tapered contact of said male plug, said receptacle body including means for electrical termination to single or multi-conductor wire; and a sleeve, concentric with and attached to said receptacle body, extending axially outward from said tapered hole with an inner diameter that allows for insertion of said bushing, having two radially opposed interlocking slots located and sized to engage the ends of said cylindrical pin of said male plug, the ends of said interlocking slots further including detent positions that lead in the outward direction to lock the connector in a fully-mated position;

wherein said bushing, said spring and said conical contact rotate with respect to said sleeve when said male plug and said female receptacle are engaged, said bushing compressing said spring against said shoulder thereby urging said conical contact into said tapered hole.

2. The connector as recited in claim 1, wherein said interlocking slots comprise two radially opposed inward ramp shaped slots located and sized to engage the ends of said cylindrical pin of said male plug, the ends of said ramp shaped slots further including detent positions that lead in the outward direction to lock the connector in a fully-mated position.

3. A connector including a male plug and a female receptacle, said male plug comprising:

a conductive conical tapered contact having a cylindrical tail protruding axially from the larger end of said contact thereby forming a shoulder at the transition, said tail having a radial groove for installation of a snap-ring, the end of said tail having means for electrical termination to single or multi-conductor wire;

a coil spring, riding on said cylindrical tail such that the bottom of said spring bears against said shoulder;

a spring-compression means, having means to interlock with said female receptacle, located so as to slide on said tail and bear against the top of said coil spring; and a snap-ring installed on said tail for retention of said spring and said spring-compression means on said tail, said female receptacle comprising:

a conductive receptacle body having a conical tapered hole with the same taper and relative size as said conical tapered contact of said male plug, said receptacle body including means for interlocking with said male plug and means for electrical termination to single or multi-conductor wire;

wherein said spring-compression means rotates with respect to said female receptacle when said male plug and said female receptacle are engaged, said engagement causing said spring-compression means to compress said spring against said shoulder thereby urging said conical contact into said tapered hole.

4. A connector including a male plug and a female receptacle, said male plug comprising:

a conductive conical tapered contact having a cylindrical tail protruding axially from the larger end of said contact thereby forming a shoulder at the transition, said tail having an axial bore for installation of a pin, the end of said tail having means for electrical termination to single or multi-conductor wire;

a coil spring, riding on said cylindrical tail such that the bottom of said spring bears against said shoulder;

a spring-compression means, having means to interlock with said female receptacle, located so as to slide on said tail and bear against the top of said coil spring; and a pin retention-means installed on said tail, said pin retention-means extending from said tail for retention of said spring and said spring-compression means on said tail, said female receptacle comprising:

a conductive receptacle body having a conical tapered hole with the same taper and relative size as said conical tapered contact of said male plug, said receptacle body including means for interlocking with said male plug and means for electrical termination to single or multi-conductor wire;

wherein said spring-compression means rotates with respect to said female receptacle when said male plug and said female receptacle are engaged, said engagement causing said spring-compression means to compress said spring against said shoulder thereby urging said conical contact into said tapered hole.

* * * * *